United States Patent [19]

Brough

[11] Patent Number: 4,538,409

[45] Date of Patent: Sep. 3, 1985

[54] CROSSED BELT FALSE TWIST DEVICES

[75] Inventor: Denys W. Brough, Macclesfield, England

[73] Assignee: Rieter-Scragg Limited, Cheshire, England

[21] Appl. No.: 536,272

[22] Filed: Sep. 27, 1983

[30] Foreign Application Priority Data

Oct. 12, 1982 [GB] United Kingdom ..... 8229169

[51] Int. Cl.[3] ..... D02G 1/06; D01H 7/92

[52] U.S. Cl. ..... 57/336

[58] Field of Search ..... 57/332, 336, 284

[56] References Cited

U.S. PATENT DOCUMENTS

| | | | |
|---|---|---|---|
| 2,592,818 | 4/1952 | Moessinger | 57/336 X |
| 4,047,373 | 9/1977 | Takai | 57/336 |
| 4,144,701 | 3/1979 | Takai et al. | 57/336 |
| 4,296,598 | 10/1981 | Faure | 57/336 X |
| 4,400,931 | 8/1983 | Maeda | 57/336 |

FOREIGN PATENT DOCUMENTS

| | | |
|---|---|---|
| 2102844 | 7/1981 | United Kingdom . |
| 2090293 | 7/1982 | United Kingdom . |

*Primary Examiner*—Donald Watkins

*Attorney, Agent, or Firm*—Oblon, Fisher, Spivak, McClelland & Maier

[57] ABSTRACT

A crossed belt false twist device for texturing yarn which includes two belts supported by pulleys to provide two free runs crossing at a crossing region which is nearer to one pulley in each case than to the other pulley. Longer belts can be used than heretofore known without sacrificing stability and control, thereby also reducing wear and allowing cooler running.

12 Claims, 2 Drawing Figures

CROSSED BELT FALSE TWIST DEVICES

BACKGROUND OF THE INVENTION

This invention relates to crossed belt false twist devices for use in texturising yarn. Such devices usually comprise a pair of crossed belts trained over pulleys, and thread guide means guiding a thread between the belts at the crossing point so that it is engaged on opposite sides by the travelling belts and thus twisted.

Because the belts are necessarily pressed against each other, they wear, and must be changed from time to time. Belt changing involves machine downtime and lost production.

It is an object of the invention to provide crossed belt false twist devices that need relatively infrequent belt changes to thereby minimize machine downtime and associated costs and losses.

SUMMARY OF THE INVENTION

An object of the present invention is to provide a crossed belt false twist device having at least one belt trained over pulleys to have a first free, unsupported run extending therebetween which crosses at a crossing region with a second free run, the mid-point of the crossing region being nearer to one of said pulleys than to the other. The distance, between the mid-point of the crossing region and the point at which the belt is tangent to the nearer pulley may be between 0.5 and 0.25 times the radius of said nearer pulley.

The or each belt may be longer, even substantially longer, than has been the practice hitherto, and this will reduce proportionally the frequency with which the belt or belts require to be changed. More specifically the length of either free run may be at least 2.5 times the radius of each of said pulleys, and the or each belt may have a free run of at least 25 cm, preferably at least 30 cm.

Preferably, the crossing angle of the belt runs is adjustable while the crossing region remains substantially at the same position, relative to said pulleys.

The device may comprise two belts, each of which provides one of said first and second runs, in which case the belts may be similar to each other and similarly supported.

One embodiment of a crossed belt false twist device according to the invention will now be described with reference to the following drawings in which:

DETAILED DESCRIPTION OF THE PREFERRED EMBODIMENT

Figure 1:
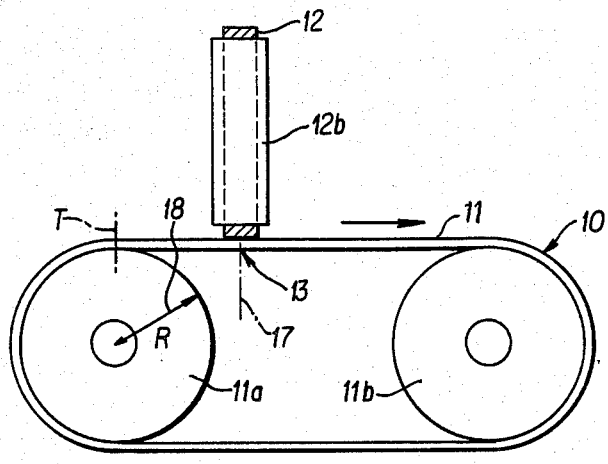
FIG. 1 is a sectional, elevational view of a crossed belt false twist device, taken along line 1—1 of FIG. 2.
Figure 2:
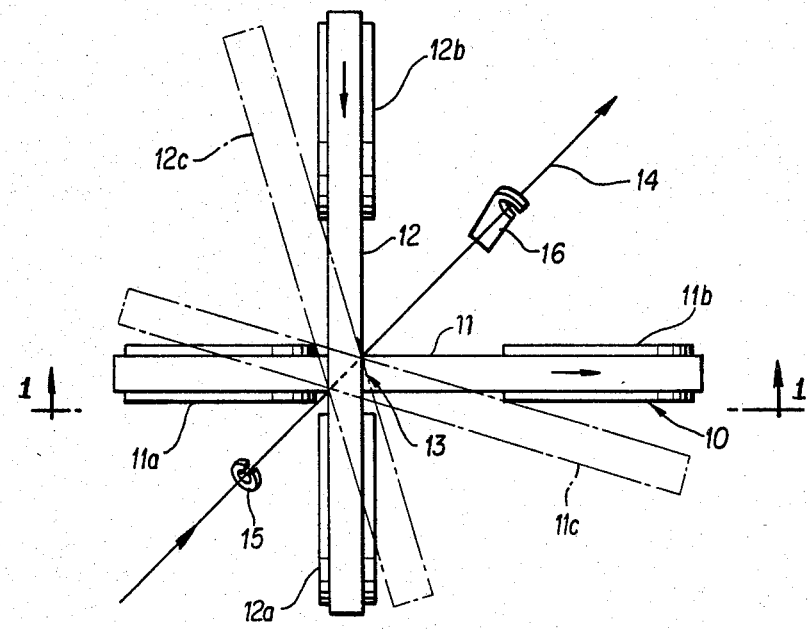
FIG. 2 is a plan view of the device shown in FIG. 1.

The crossed belt false twist device 10 illustrated in FIGS. 1 and 2 comprises belts 11,12 trained over pulleys 11*a*, 11*b* and 12*a*, 12*b* respectively.

The belts 11,12 travel as indicated by the arrows and cross at a crossing region 13. A yarn 14 (FIG. 2) is guided through the crossing region 13 by input and output guides 15,16 respectively, the yarn being false twisted by being contacted from opposite sides by the travelling belts 11,12.

In FIG. 1, the belt 12 is seen in cross section and only pulley 12*b* is visible, edge on, the belts 11, 12 in this illustration being at right angles.

The length of the belt 11 is such that its free, unsupported run between the pulleys 11*a*, 11*b* is greater than 2.5 times the radius R of the pulleys. In this embodiment the pulleys have the same radius, though one, of course, could be bigger than the other, in which case, the free run of the belt 11 would be at least 2.5 times the radius of the larger pulley.

The distance of the mid-point of the crossing region - indicated by the line 17 in FIG. 1—from the point T where the belt 11 is tangent to the pulley 11*a* is 1.25 R.

This distance is regarded as the maximum distance from the mid-point of the crossing region to the tangent point T. A line 18 in FIG. 1 distant 0.5 R from tangent point T is regarded as the minimum distance for the mid-point of the crossing region.

When the mid-point of the crossing region is between positions indicated by lines 17 and 18 (i.e. closer to pulley 11*a* than pulley 11*b*) in the case of both belts, particularly stable operation of the false twist device is obtained even though the belts themselves be of considerable length, reducing wear and the frequency of belt changes, without the need additionally to support the belts intermediate the pulleys. Furthermore with the arrangement of the present invention longer belts may be used than have been used heretofore, having free runs of at least 25 cm, preferably at least 30 cm, without sacrificing stability and control. Such longer belts run at lower temperatures than the previously used relatively short belts, thereby further prolonging belt life.

Although in FIGS. 1 and 2 the belts 11,12 have been shown crossing at right angles, the crossing angle may of course be different and is preferably selectable so as to correspond to the desired twist angle. For a substantially slip-free, positive twisting/forwarding action, the crossing angle is about twice the twist angle. Any belt run crossing within the range of adjustment of the device, as illustrated in FIG. 2 by the broken lines 11*c*,12*c* representing the displaced belts 11,12, should take place about the mid-point of the crossing region as axis.

I claim:

1. A crossed belt false twist device, comprising:

a first and second pair of pulleys;

a belt trained over each of said first and second pair of pulleys so as to provide first and second free unsupported belt runs, said first free run travelling from a first pulley to a second pulley and crossing at a crossing region with said second free run, the mid-point of said crossing region being nearer to said first pulley of said first pair of pulleys than to said second pulley of said first pair of pulleys.

2. A device according to claim 1 wherein the distance between the mid-point of the crossing region and the point at which said belt is tangent to said first pulley of said first pair of pulleys is between 0.5 and 1.25 times the radius of said first pulley of said first pair of pulleys.

3. A device according to claim 1 wherein the length of either of said free runs is at least 2.5 times the radius of each of said pulleys.

4. A device according to claim 1 wherein either of said free runs is at least 25 cm in length.

5. A device according to claim 1 wherein the free runs cross each other at a crossing angle which is adjustable.

6. A device according to claim 5 wherein the crossing angle is adjusted about the mid-point of the crossing region as axis.

7. A device according to claim 6 wherein the position of the crossing region relative to said pulleys remains substantially constant throughout the range of adjustment of the belt crossing angle.

8. A device according to claim 1 comprising two belts each of which provides one of said first and second runs.

9. A device according to claim 8 wherein said belts are similar to each other.

10. A device according to claim 8 wherein said belts are similarly supported.

11. A device according to claim 1 wherein said mid-point of said crossing region is nearer to respective first pulleys of said first and second pair of pulleys than to respective second pulleys of said first and second pair of pulleys.

12. A device according to claim 10 wherein said pulleys are of substantially equal diameter.

* * * * *